US006466675B1

(12) United States Patent
Tracy

(10) Patent No.: US 6,466,675 B1
(45) Date of Patent: Oct. 15, 2002

(54) LOUDSPEAKER SYSTEM

(76) Inventor: Dennis A. Tracy, 11136 Washington Blvd., Culver City, CA (US) 90232

( * ) Notice: Subject to any disclaimer, the term of this patent is extended or adjusted under 35 U.S.C. 154(b) by 48 days.

(21) Appl. No.: 09/611,442

(22) Filed: Jul. 6, 2000

Related U.S. Application Data

(60) Provisional application No. 60/142,445, filed on Jul. 6, 1999.

(51) Int. Cl.[7] ..... H04R 25/00

(52) U.S. Cl. ..... 381/182; 381/300; 381/186

(58) Field of Search ..... 381/300, 89, 332, 381/335, 336, 182, 186, 386, 189, 391; 181/144, 145, 147

(56) References Cited

U.S. PATENT DOCUMENTS 4,042,778 A * 8/1977 Clinton ..... 381/182
4,230,905 A * 10/1980 Crum et al. ..... 381/300
4,553,630 A * 11/1985 Ando ..... 381/182
5,388,162 A * 2/1995 Sohn ..... 381/182
5,533,129 A * 7/1996 Gefvert ..... 381/300

FOREIGN PATENT DOCUMENTS

JP 54-180728 * 9/1961 ..... 381/182

* cited by examiner

*Primary Examiner*—Huyen Le
(74) *Attorney, Agent, or Firm*—Welsh & Flaxman LLC

(57) ABSTRACT

The invention relates to a loudspeaker system. The loudspeaker system respectively includes first and second satellite speaker having a housings supporting a high frequency driver and a middle frequency driver. Each housing forms a complete enclosure with a single opening and the middle frequency driver includes a magnet and a cone. The middle frequency drivers are respectively mounted within the single openings of the housings such the middle frequency drivers seal the interior of the housings from an external environment and the magnets are directed away from the interior of the housings. The high frequency drivers are mounted to the housings for movement in a plurality of planes. The system further includes a subwoofer having a subwoofer housing in which at least one low frequency driver is mounted. The invention further relates to the specific loudspeakers forming the present system.

19 Claims, 6 Drawing Sheets

LOUDSPEAKER SYSTEM

CROSS-REFERENCE TO RELATED APPLICATIONS

This U.S. patent application is based upon U.S. Provisional Patent Application Serial No. 60/142,445, filed Jul. 6, 1999, and entitled "LOUDSPEAKER SYSTEM".

BACKGROUND OF THE INVENTION

1. Field of the Invention

The invention relates to a loudspeaker system. More particularly, the invention relates to a small, aesthetically pleasing loudspeaker system which does not sacrifice sound quality for size.

2. Description of the Prior Art

Loudspeaker technology has consistently attempted to reproduce a recorded sound in the most realistic manner possible. In fact, the goal of many designers is the creation of a loudspeaker which sounds as if the singer and/or musician are playing across the room.

The vast majority of loudspeaker designs employ a variety of sound drivers mounted within an acoustic box. The sound drivers are mounted along a face of the acoustic box in the direction along which the sound is to be directed. These designs dictate that relatively large drivers are mounted within a relatively large box.

While these large loudspeakers often produce very high quality sound, their size makes them difficult, if not impossible, to discretely position within a room. Many manufacturers have attempted to remedy size problems by providing small loudspeakers sized to conveniently sit on a bookshelf or coffee table. Unfortunately, these smaller loudspeakers sacrifice sound quality for size. Since they are smaller and may not accommodate drivers for a variety of frequency ranges, they are unable to offer the full range of sounds the larger loudspeakers offer.

The overwhelming popularity and usefulness of personal computers have made the lack of small, high quality loudspeakers even more apparent. Computer users require high quality sound to play games, listen to music while working and even watch movies on their computer monitors. In some instances, an individual's computer forms the central module in an elaborate multimedia environment including DVD, Digital Dolby processing and high definition television. When all of these high quality components interact to create a realistic entertainment environment, it is highly frustrating to settle for moderate quality loudspeakers because high quality loudspeakers are simply too big to place on a desktop.

As such, a need exists for small, aesthetically pleasing loudspeakers, which do not sacrifice sound quality for reductions in the size of the loudspeakers. The present loudspeaker system overcomes the limitations of the prior art.

SUMMARY OF THE INVENTION

It is, therefore, an object of the present invention to provide a loudspeaker system. The loudspeaker includes a first satellite speaker having a first housing supporting a first high frequency driver and a first middle frequency driver. The first housing forms a complete enclosure with a single opening and the first middle frequency driver includes a magnet and a cone with a concave portion and a convex portion. The first middle frequency driver is mounted within the single opening of the first housing such the first middle frequency driver seals the interior of the first housing from an external environment and the concave portion of the cone is directed to an interior of the first housing while the magnet is directed away from the interior of the first housing. The first high frequency driver is mounted to the first housing for movement in a plurality of planes. The system further includes a second satellite speaker having a second housing supporting a second high frequency driver and a second middle frequency driver. The second housing forms a complete enclosure with a single opening and the second middle frequency driver includes a magnet and a cone with a concave portion and a convex portion. The second middle frequency driver is mounted within the single opening of the second housing such that the second middle frequency driver seals the interior of the second housing from an external environment and the concave portion of the cone is directed to an interior of the second housing while the magnet is directed away from the interior of the second housing. The second high frequency driver is mounted to the second housing for movement in a plurality of planes. The system further includes a subwoofer having a subwoofer housing in which at least one low frequency driver is mounted.

It is also an object of the present invention to provide a loudspeaker including a speaker housing supporting a first driver and a second driver. The housing forms an enclosure with a single opening. The first driver includes a magnet and a cone with a concave portion and a convex portion. The first driver is mounted within the single opening of the housing such the driver seals the interior of the housing from an external environment and the concave portion of the cone is directed to an interior of the housing while the magnet is directed away from the interior of the housing such that the magnet forms a support base for the loudspeaker. The second driver is mounted to the housing for movement in a plurality of planes.

It is further an object of the present invention to provide a loudspeaker including a frustoconically shaped speaker housing supporting a first driver and a second driver. The housing forms an enclosure with a single opening. The first driver includes a magnet and a cone with a concave portion and a convex portion. The first driver is mounted within the single opening of the housing such the driver seals the interior of the housing from an external environment and the concave portion of the cone is directed to an interior of the housing while the magnet is directed away from the interior of the housing. The second driver is mounted to the housing for movement in a plurality of planes.

It is another object of the present invention to provide a loudspeaker including a housing with a first member forming a complete enclosure with a single opening and a second member forming a complete enclosure with a single opening. The opening of the first member and the opening of the second opening are opposed. A first driver, including a magnet and a cone with a concave portion and a convex portion, is mounted within the single opening of the first member such that the driver seals the interior of the first member to form an internal environment and the concave portion of the cone is directed to an interior of the first member while the magnet is directed away from the interior of the first member. A second driver, including a magnet and a cone with a concave portion and a convex portion, is mounted within the single opening of the second member such that the driver seals the interior of the second member to form an external environment and the concave portion of the cone is directed to an interior of the second member while the magnet is directed away from the interior of the second member.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
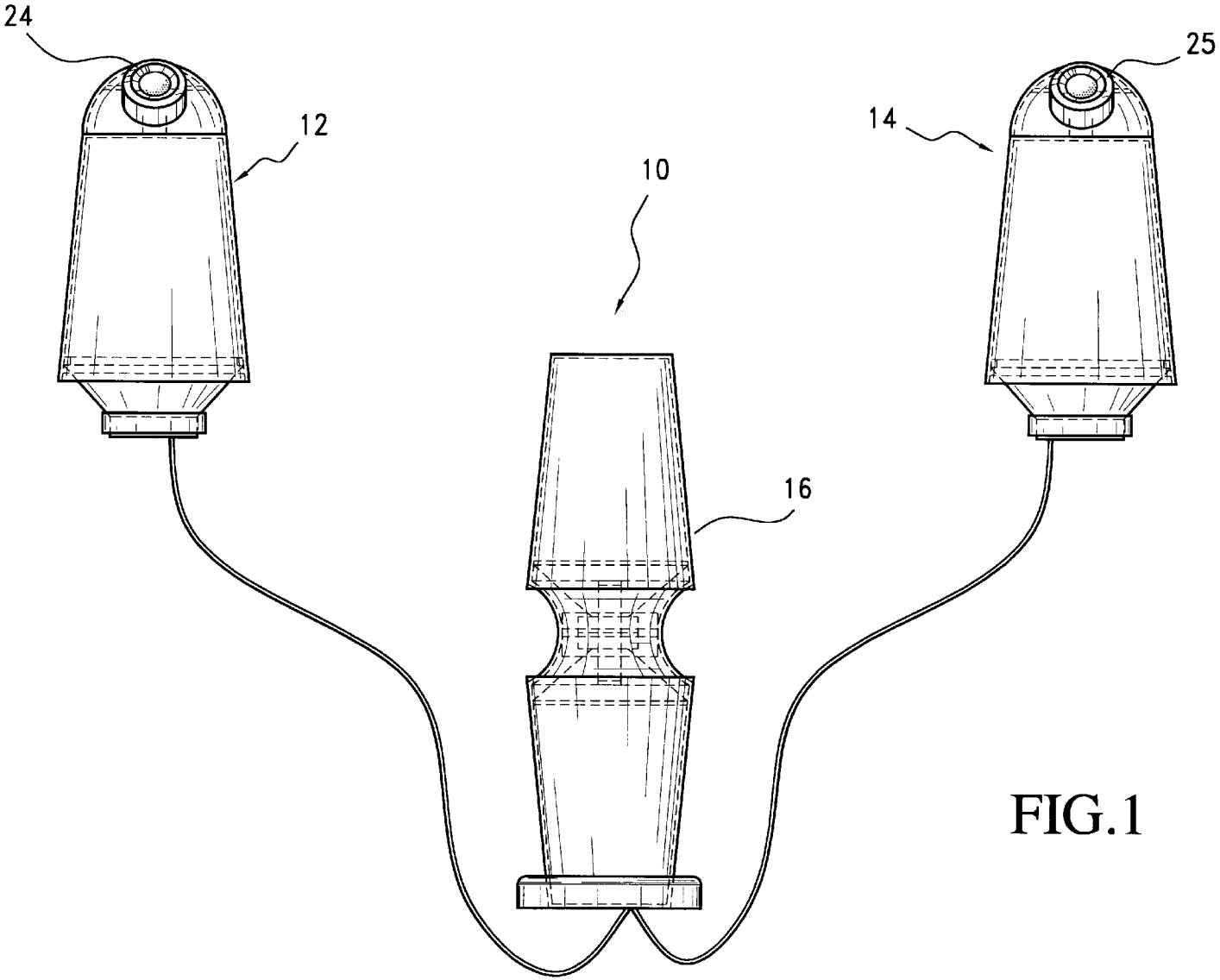
FIG. 1 is a perspective view of a loudspeaker system in accordance with the present invention.

With reference to FIG. 1, a loudspeaker system 10 in accordance with the present invention is disclosed. The system 10 includes a first satellite speaker 12, a second satellite speaker 14 and a subwoofer 16. The first and second satellite speakers 12, 14, in combination with the subwoofer 16, provide high quality sound while employing a small, aesthetically pleasing design.

In fact, and in accordance with the preferred embodiment of the present invention, the first and second satellite speakers 12, 14 are no taller than approximately 6" with a maximum diameter of approximately 3", and the subwoofer 16 is no taller than approximately 12" with a maximum diameter of approximately 6". In addition, the smallest practical size envisioned for the satellite speakers 12, 14 is a height of 4" and a diameter of 2.5", while the smallest practical size envisioned for the subwoofer 16 is a height of 10" and a diameter of 4.5". While these are the preferred dimensions of the present loudspeaker system 10, the system may be designed with other dimensions without departing from the spirit of the present invention. For example, where size is not an important consideration, the components of the loudspeaker system may be substantially larger to meet specific needs.

The first and second satellite speakers 12, 14 are identical. When used in accordance with the preferred embodiment of the present invention, the satellite speakers 12, 14 respectively reproduce the left and right channels of conventional recordings. The satellite speakers 12, 14 may also be used as rear speakers in a surround sound audio-visual system. In addition, the satellite speakers 12, 14 may be used in groups of one, or more, to suit the needs of various applications.

The first satellite speaker 12 will now be described in detail. It should be appreciated that the following explanation applies to the second satellite speaker 14, as well as any additional speakers that might be used in accordance with the present invention.

Figure 3:
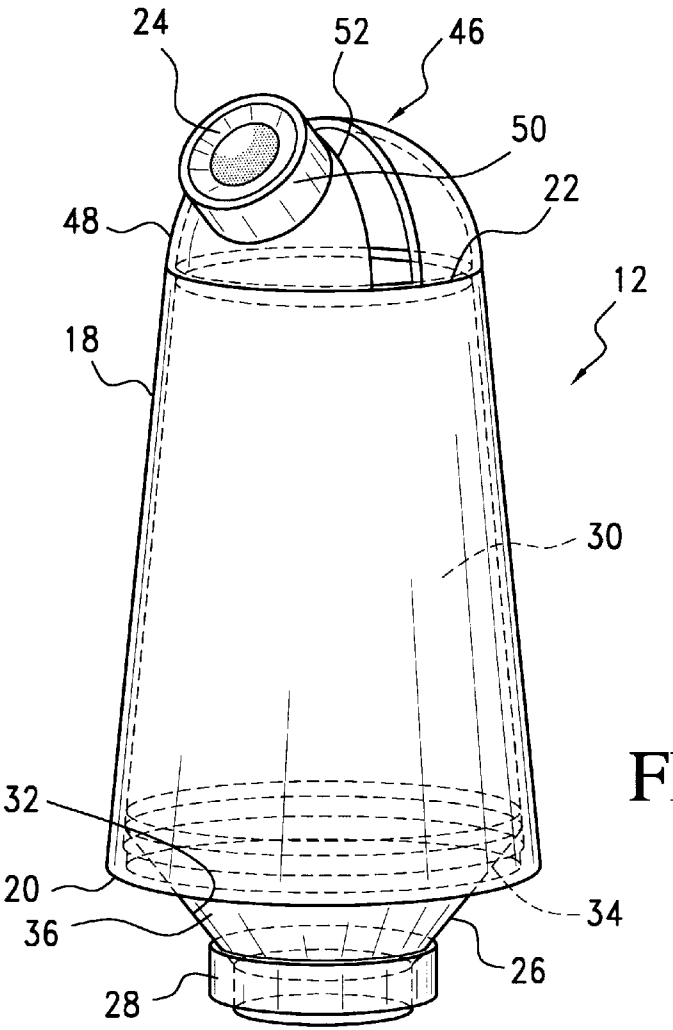
FIG. 3 is a line depiction of the satellite speaker shown in FIG. 2.
Figure 2:
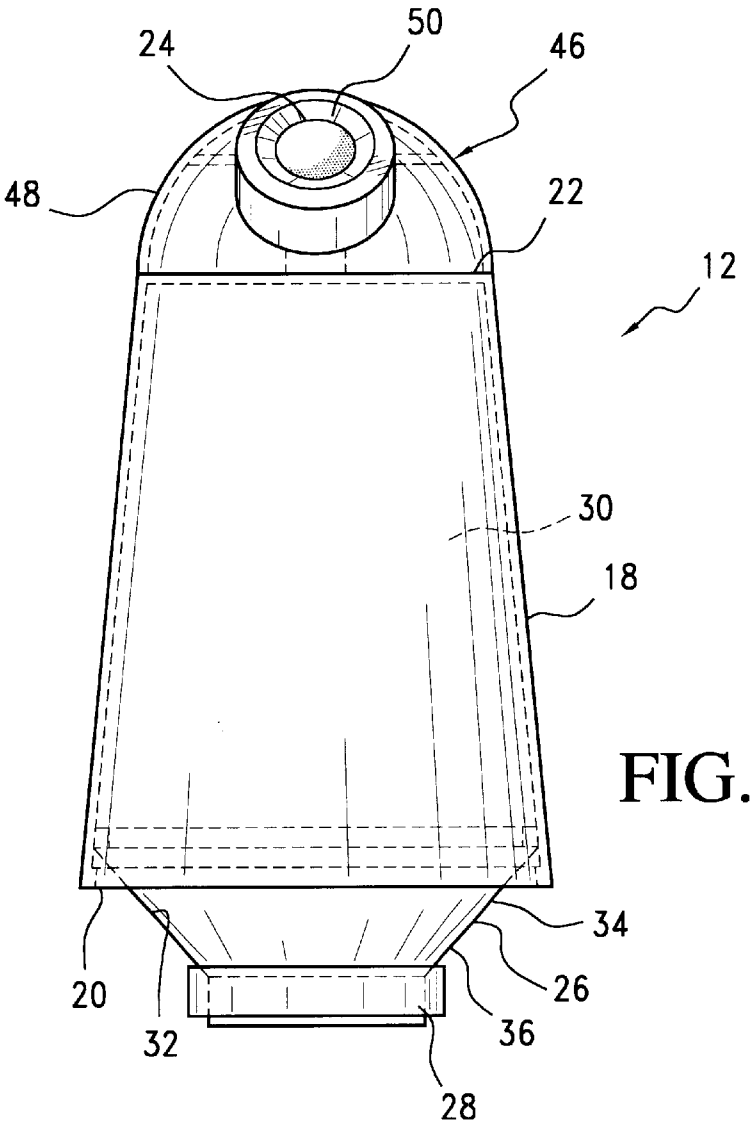
FIG. 2 is a front plan view of the satellite speaker in accordance with the present invention.

The first satellite speaker 12 is shown in detail in FIGS. 2 and 3. The satellite speaker 12 includes a frustoconical housing 18. The housing 18 includes a large diameter open end 20 and a small diameter closed end 22. The housing 18 is preferably made from lightweight aluminum with a thickness of approximately 0.040 in., although other materials could be used without departing from the spirit of the present invention.

The housing 18 supports a first high frequency driver 24 (generally referred to as a tweeter) and a first middle frequency driver 26 (generally referred to as a mid-range). The first high frequency driver 24 reproduces sound in the directional frequency range. As such, the first and second satellite speakers 12, 14, and particularly, the first and second high frequency drivers 24, 25, may be placed some distance apart to create a stereo image.

The first middle frequency driver 26 is mounted within the large diameter open end 20 of the housing 18 such that the drivers's magnet 28 is the base upon which the first satellite speaker 12 is supported when placed on a support surface. The first middle frequency driver 26 completely closes off the large diameter open end 20 of the housing 18 and seals the interior 30 of the housing 18 from the external environment. The first middle frequency driver 26 is mounted within the large diameter open end 20 of the housing 18 with the concave portion 32 of the driver cone 34 directed toward the interior 30 of the housing 18, while the convex portion 36 of the driver cone 34 and the magnet 28 are directed away from the interior 30 of the housing 18.

The first middle frequency driver 26 is securely mounted within the large diameter open end 20 of the housing 18. Adhesive secures the first middle frequency driver 26 within the large diameter open end 20 of the housing 18, although other mounting techniques may be used without departing from the spirit of the present invention so long as the first middle frequency driver 26 completely closes off the large diameter open end 20 of the housing 18, sealing the interior 30 of the housing 18 from the external environment.

By mounting the first middle frequency driver 26 in this way, sound is emitted from the convex portion 36 of the driver cone 34 and directed to the listener. In addition, sound emitted from the concave portion 32 resonates the housing 18 and is also transmitted to a listener.

The first high frequency driver 24 is pivotally and rotatably mounted on the small diameter closed end 22 of the housing 18. Specifically, the first high frequency driver 24 is mounted within a rotating dome 46 coupled to the small diameter closed end 22 of the housing 18.

The dome 46 includes a dome housing 48 with a central slot 50 in which the first high frequency driver 24 is mounted. The dome housing 48 is rotatably coupled to the small diameter closed end 22 of the housing 18, allowing the first high frequency driver 24 to rotate approximately 300° as desired by the listener.

The first high frequency driver 24 is pivotally mounted within the dome 46, allowing the first high frequency driver 24 to pivot freely along an arc defined by the slot 50. An apron 52 covers the exposed portions of the slot 50 which revolves with the first high frequency driver 24 as the driver 24 pivots within the dome housing 48.

Figure 5:
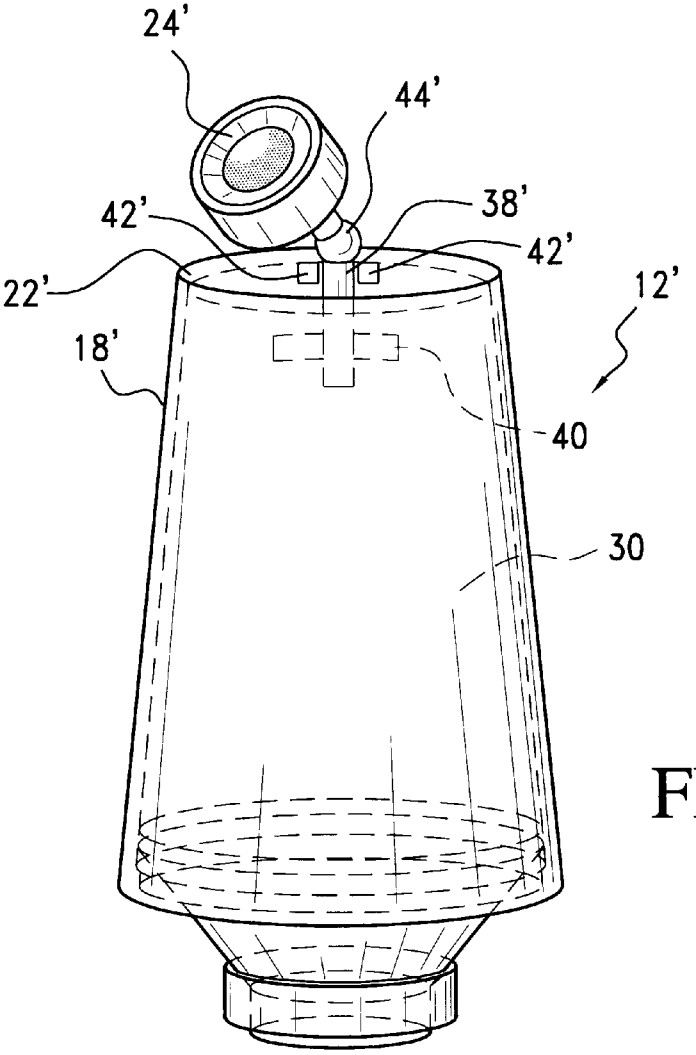
FIG. 5 is a line depiction of the satellite speaker shown in FIG. 4.
Figure 4:
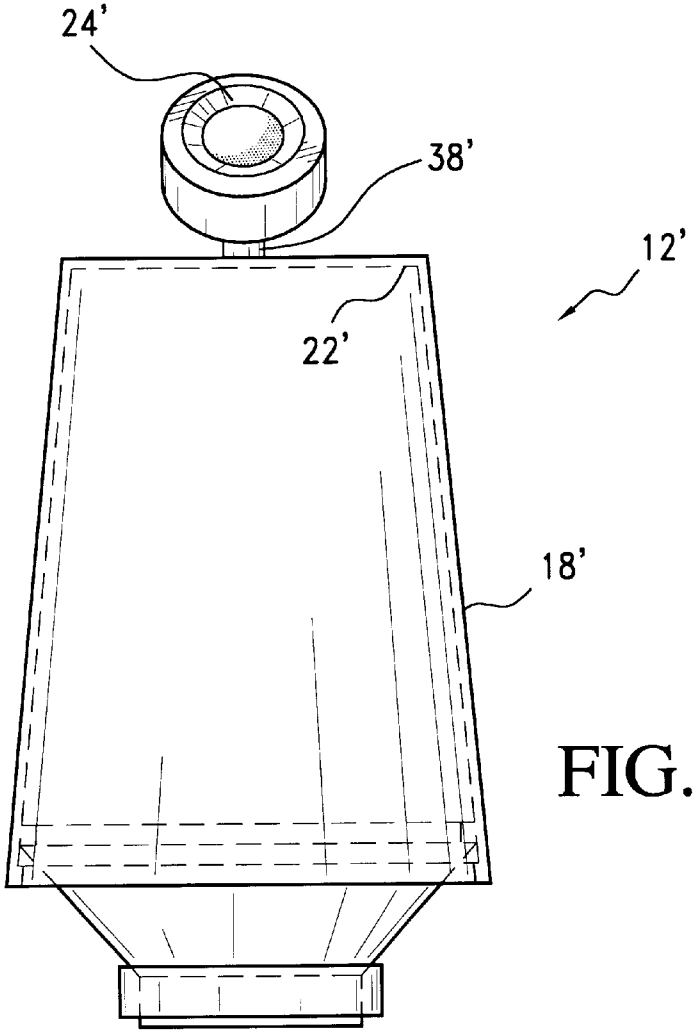
FIG. 4 is a front plan view of an alternate embodiment of the satellite speaker.

An alternate embodiment of the first satellite speaker 12' is disclosed in FIGS. 4 and 5. The alternate embodiment is identical to the embodiment disclosed with reference to FIGS. 2 and 3, with the exception that the mounting structure for the first high frequency driver 24' is modified. In accordance with the alternate embodiment, a mounting arm 38' secures the first high frequency driver 24' to the small diameter closed end 22' of the housing 18'. The mounting arm 38' further supports an inductor 40' for the crossover network (not shown) employed in driving the present speaker. The mounting arm 38' is rotatably mounted to the small diameter closed end 22' of the housing 18', and allows the first high frequency driver 24' to rotate about a defined arc. For example, the mounting arm 38' is preferably mounted to rotate approximately 300°, and stops 42' are provided for limiting the rotation as desired. While a preferred range of motion is disclosed, the range of motion may be readily varied without departing from the spirit of the present invention.

The mounting arm 38' also includes a hinge 44' permitting rotation in second plane. The hinge 44' allows the first high frequency driver 24' to pivot about an axis generally perpendicular to the axis about which the driver 24' is permitted to rotate 300°.

The satellite speakers in accordance with present invention produce both directional (high frequency) and nondirectional (middle and low frequency) sound from a single source. The generated sound is optimized by proportionally balancing the directional and nondirectional sound to a desirable listening level.

In fact, by permitting the high frequency drivers to move, the present satellite speakers allow an individual to selectively direct the sound field to produce a coherent stereo image even when the satellite speakers are not optimally positioned. In this way, the stereo image created by the spaced apart satellites is not overly diminished when one places the satellite speakers at positions which are not centered about the listener. This characteristic is highly advantageous where the satellites are used in conjunction with a computer and there is not sufficient space for the placement of the satellite speakers on opposite sides of the computer monitor. The ability of the present satellite speakers to create such a stereo image is enhanced by the speakers capacity to minimize the directional sound generated by the middle frequency drivers of the first and second satellites.

In addition, the positioning of the first middle range driver within the open end of the housing substantially moves the satellite's center of gravity downward. Lowering the center of gravity in this way provides the satellite with improved stability.

While two alternate embodiments for mounting the first high frequency are disclosed above, other mounting structures may be employed without departing from the spirit of the present invention. In addition, while the preferred housing is frustoconical, other housing shapes may be adopted without departing from the spirit of the present invention.

Figure 6:
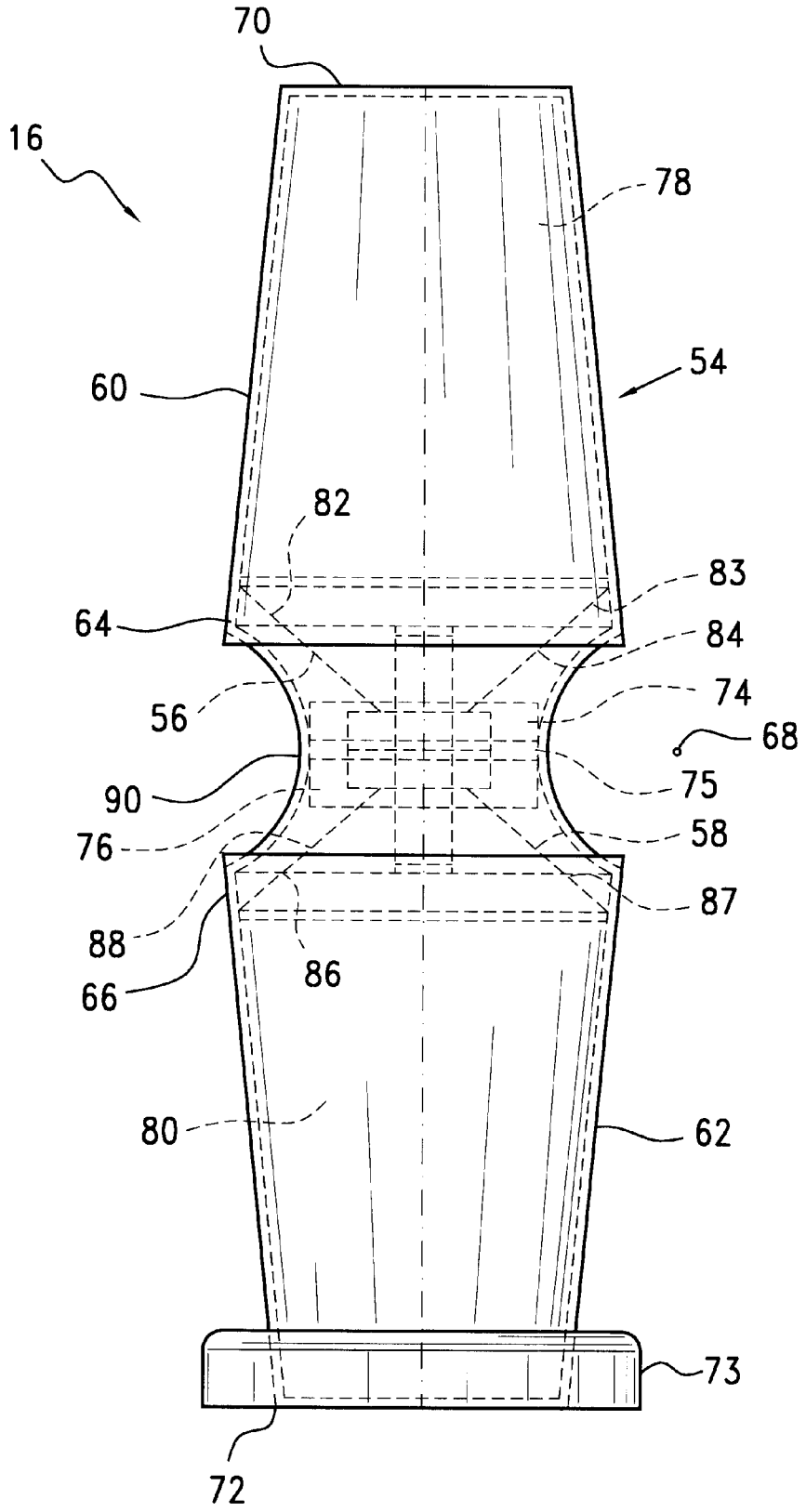
FIG. 6 is a front plan view of the subwoofer in accordance with the present invention.
Figure 7:
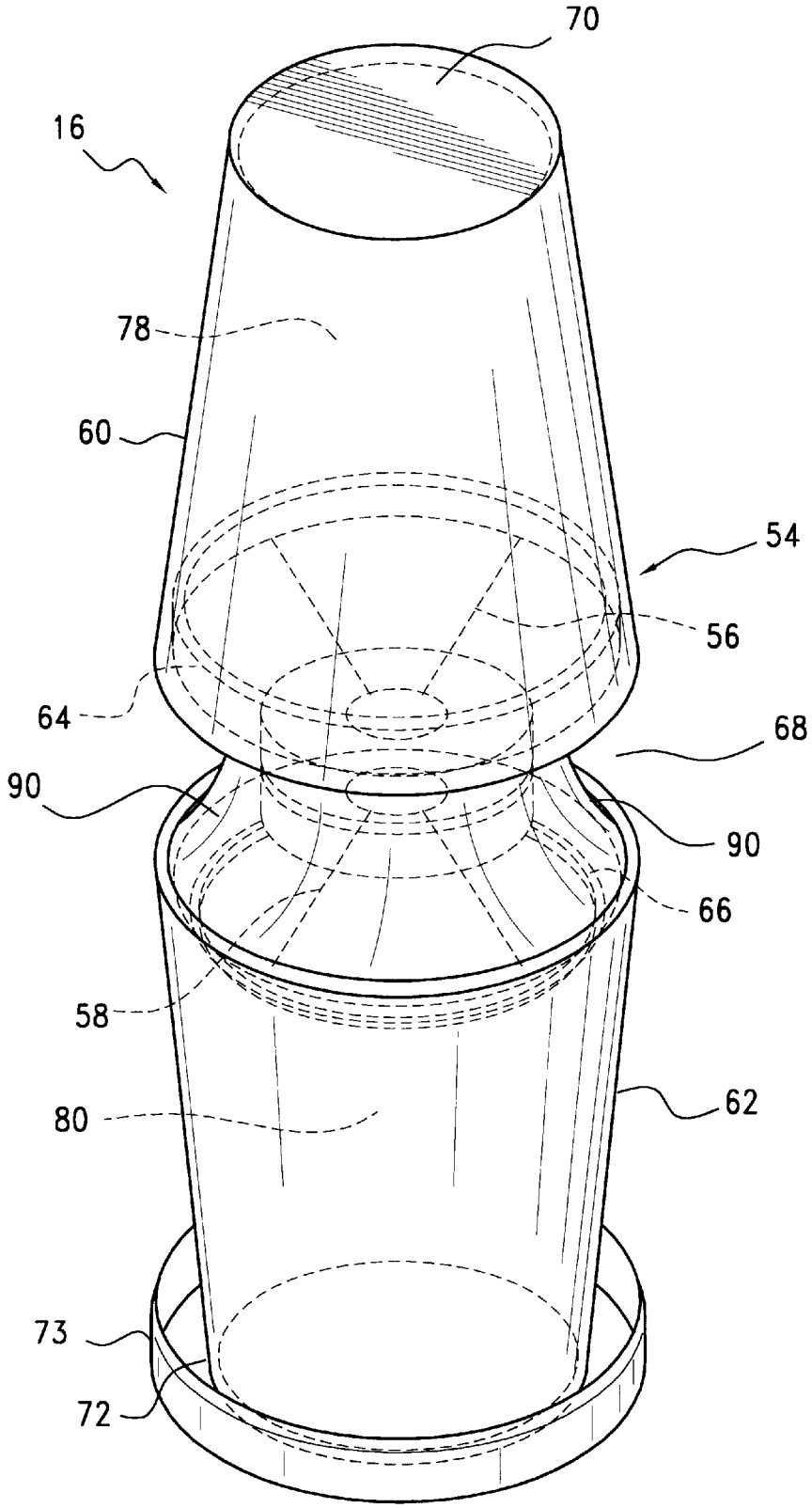
FIG. 7 is a line drawing of the subwoofer shown in FIG. 6.

The subwoofer 16 is disclosed in detail in FIGS. 6 and 7. The subwoofer 16 includes a housing 54 in which opposed low frequency drivers 56, 58 are mounted in a push/pull 40 arrangement. The subwoofer housing 54 includes opposed first and second frustoconical members 60, 62 coupled at their large diameter open ends 64, 66 to form the subwoofer housing 54. As with the satellite housing 18, the first and second frustoconical members 60, 62 are preferably manufactured from aluminum, although other materials may be used without departing from the spirit of the present invention.

The large diameter open ends 64, 66 of the first and second frustoconical members 60, 62 are separated to create an open space 68 for mounting first and second low frequency drivers 56, 58 therein. The small diameter ends 70, 72 of both the first and second frustoconical members 60, 62 are closed. A base member 73 is attached to the small diameter end 72 of the second frustoconical member 62.

A first low frequency driver 56 is mounted within the large diameter open end 64 of the first frustoconical member 60 and a second low frequency driver 58 is mounted within the large diameter open end 66 of the second frustoconical member 62. The first and second low frequency drivers 56, 58 oppose each other to produce a desirable bass response exiting the open space 68 created between the first and second frustoconical members 60, 62. Thin mumetal 75, shields the magnet 74 of the first low frequency driver 56 from the magnet 76 of the second low frequency driver 58 to prevent magnet interference between the first low frequency driver 56 and the second low frequency driver 58. While the use of a magnetic barrier is not required in with the first and second satellite speakers 12, 14, mumetals may be incorporated with the satellite speakers where specific applications require magnetic shielding.

As with the first middle frequency driver 26, the first and second low frequency drivers 56, 58 are fully sealed within the large diameter open ends 64, 66 of the first and second frustoconical members 60, 62, respectively, such that the drivers 56, 58 respectively seal the interiors 78, 80 of the frustoconical members 60, 62 from the external environment. The first low frequency driver 56 is mounted within the large diameter open end 64 of the first frustoconical member 60 with the concave portion 82 of the driver cone 83 directed toward the interior 78 of the frustoconical member 60, while the convex portion 84 of the driver cone 83 and the magnet 74 are directed away from the interior 78 of the frustoconical member 64. Similarly, the second low frequency driver 58 is mounted within the large diameter open end 66 of the second frustoconical member 62 with the concave portion 86 of the driver cone 87 directed toward the interior 80 of the frustoconical member 62, while the convex portion 88 of the driver cone 87 and the magnet 76 are directed away from the interior 80 of the frustoconical member 62.

A series of support arms 90 maintains the first and second frustoconical members 60, 62 in the opposed relationship. Specifically, the support arms 90 extend between the large diameter open ends 64, 66 of the first frustoconical member 60 and the second frustoconical member 62.

As with the middle frequency drivers, the first and second low frequency drivers 56, 58 emit sound from the convex portion 84, 88 of their cones 83, 87 and direct it to the listener. In addition, sound emitted from the concave portion 82, 86 of the first and second low frequency drivers 56, 58 resonates the housing 54 and is also transmitted to a listener.

The subwoofer 16 is further provided with a conventional crossover circuit (not shown). In this way, the present loudspeaker system 10 may be wired to a conventional receiver in much the same manner prior art subwoofer/satellites are wired. The first and second low frequency drivers 12, 14 are wired to reproduce left and right low frequency channels, respectively. In addition, the subwoofer 16 may be modified to include a separate amplifier, and thereby function as a powered subwoofer. In this alternate embodiment, the first and second low frequency drivers 56, 58 would be wired to reproduce the combined low frequency channels.

The disclosed first and second satellite speakers 12, 14 and subwoofer 16 generate ideal sound reproduction. More particularly, the combination of a pivotally mounted high frequency driver 24, 25, a middle frequency driver 26 emitting sound from its convex side, and a subwoofer 16 with opposed first and second drivers 56, 58 reproduces sound in an ideal manner without occupying valuable space.

In addition, high fidelity sound is created by properly matching the drivers with the housing materials. In this way, the resonant peaks of the generated sound are improved and the resulting sound is improved. Further, the sloped shaped of the frustoconical housings may result in direct cancellation of undesirable frequency due to the slope of the housing walls.

Figure 8:
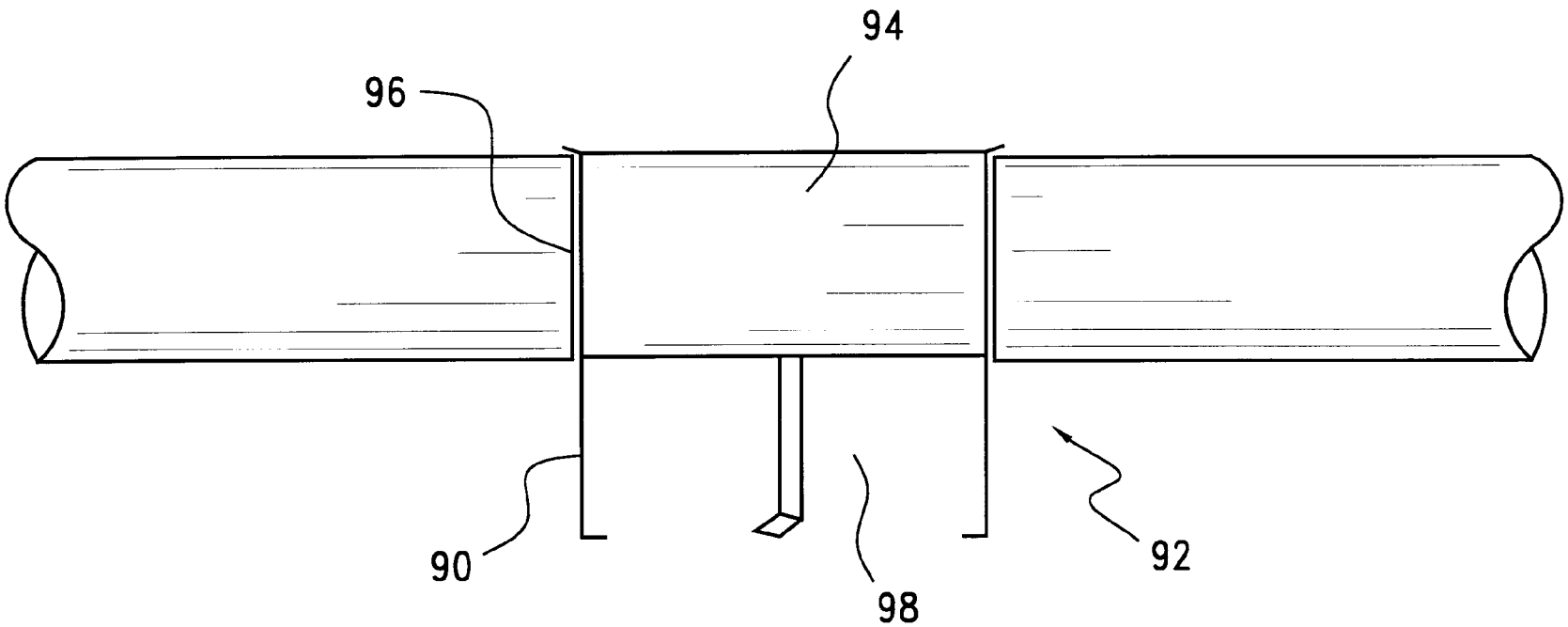
FIG. 8 is a partial cross section view of the mounting system used in accordance with the present invention.

With reference to FIG. 8, a mounting system 92 for the present satellite speaker 12, 14 is disclosed. The mounting system 92 allows one to selectively and discretely mount the satellite speakers 12, 14 of the present invention in a convenient manner. The mounting system 92 includes a housing 94 adapted for attachment within an opening 96 formed in a ceiling or wall. The housing 94 includes a central cavity 98 shaped and dimensioned to receive the magnet 28 of the middle frequency driver 26.

Specifically, the mounting system 92 includes a plurality of downwardly extending resilient support arms 100. The support arms 100 are shaped to resiliently engage the magnet 28 and securely attach the satellite speaker 12, 14 to the mounting system 92.

While the preferred embodiments have been shown and described, it will be understood that there is no intent to limit the invention by such disclosure, but rather, it is intended to cover all modifications and alternate constructions falling within the spirit and scope of the invention as defined in the appended claims.

What is claimed is:

1. A loudspeaker system, including:

a first satellite speaker including a first housing supporting a first high frequency driver and a first middle frequency driver, the first housing including a cylindrical side wall, a closed end wall and an open end which define a complete enclosure with a single opening such that the housing includes an interior separated from an external environment by the cylindrical side wall and closed end wall; the first middle frequency driver includes a magnet and a cone, the first middle frequency driver being mounted within the single opening of the first housing, and spaced from the closed end wall, such the first middle frequency driver seals the interior of the first housing from the external environment and the magnet is directed away from the interior of the first housing such that sound waves are directed toward the closed end wall of the first housing; and the first high frequency driver is mounted to the first housing for movement in a plurality of planes;

a second satellite speaker including a second housing supporting a second high frequency driver and a second middle frequency driver, the second housing including a cylindrical side wall, a closed end wall and an open end which define a complete enclosure with a single opening such that the housing includes an interior separated from an external environment by the cylindrical side wall and closed end wall; the second middle frequency driver includes a magnet and a cone, the second middle frequency driver being mounted within the single opening of the second housing, and spaced from the closed end wall, such the second middle frequency driver seals the interior of the second housing from an external environment and the magnet is directed away from the interior of the second housing such that sound waves are directed toward the closed end wall of the second housing; and the second high frequency driver is mounted to the second housing for movement in a plurality of planes; and a subwoofer including a subwoofer housing in which at least one low frequency driver is mounted.

2. The loudspeaker assembly according to claim 1, wherein the subwoofer housing includes a first member forming a complete enclosure with a single opening and a second member forming a complete enclosure with a single opening, wherein the opening of the first member and the opening of the second opening are opposed; a first driver mounted within the single opening of the first member such the first driver seals the interior of the first member from an external environment; and a second driver mounted within the single opening of the second member such the first driver seals the interior of the second member from an external environment.

3. The loudspeaker assembly according to claim 1, wherein the cone of the first middle frequency driver includes a concave portion and a convex portion, the first middle frequency driver being mounted within the single opening of the first housing such the concave portion of the cone is directed to an interior of the first housing and the cone of the second middle frequency driver includes a concave portion and a convex portion, the second middle frequency driver being mounted within the single opening of the second housing such the concave portion of the cone is directed to an interior of the second housing.

4. The loudspeaker assembly according to claim 1, wherein the first housing is frustoconical and the second housing is frustoconical.

5. The loudspeaker assembly according to claim 1, wherein the first housing is aluminum and the second housing is aluminum.

6. The loudspeaker assembly according to claim 1, wherein the first high frequency driver is mounted opposite the single opening of the first housing and second high frequency driver is mounted opposite the single opening of the second housing.

7. A loudspeaker, comprising:

a speaker housing supporting a first driver and a second driver, the housing including a cylindrical side wall, a closed end wall and an open end which define an enclosure with a single opening such that the housing includes an interior separated from an external environment by the cylindrical side wall and closed end wall;

the first driver including a magnet and a cone, the first driver being mounted within the single opening of the housing, and spaced from the closed end wall, such the driver seals the interior of the housing from the external environment and the magnet is directed away from the interior of the housing such that the magnet forms a support base for the loudspeaker and sound waves are directed toward the closed end wall; and the second driver is mounted to the housing for movement in a plurality of planes.

8. The loudspeaker according to claim 7, wherein the first driver is a middle frequency driver and the second driver is a high frequency driver.

9. The loudspeaker according to claim 7, wherein the cone of the first driver includes a concave portion and a convex portion, the first driver being mounted within the single opening of the housing such the concave portion of the cone is directed to an interior of the housing.

10. The loudspeaker according to claim 7, wherein the housing is frustoconical.

11. The loudspeaker according to claim 10, wherein the single opening is located at the larger side of the frustoconical housing.

12. The loudspeaker according to claim 11, wherein the second driver is mounted opposite the single opening of the housing.

13. The loudspeaker according to claim 7, wherein the housing is aluminum.

14. The loudspeaker according to claim 7, wherein the second driver is mounted opposite the single opening of the housing.

15. A loudspeaker, comprising:

a housing including a first member forming a complete enclosure with a single opening and a second member forming a complete enclosure with a single opening, wherein the opening of the first member and the opening of the second opening are opposed;

a first driver mounted within the single opening of the first member such the first driver seals the interior of the first member from an external environment;

a second driver mounted within the single opening of the second member such the second driver seals the interior of the second member from an external environment; and wherein the first driver includes a magnet and a cone with a concave portion and a convex portion, the first driver being mounted within the single opening of the first member such the first driver seals the interior of the first member from an external environment and the concave portion of the cone is directed to an interior of the first member while the magnet is directed away from the interior of the first member; and the second driver includes a magnet and a cone with a concave portion and a convex portion, the second driver being mounted within the single opening of the second member such the second driver seals the interior of the second member from an external environment and the concave portion of the cone is directed to an interior of the second member while the magnet is directed away from the interior of the second member.

16. The loudspeaker according to claim 15, wherein the first driver is a low frequency driver and the second driver is a low frequency driver.

17. The loudspeaker according to claim 15, wherein the first member is frustoconical and the second member is frustoconical.

18. The loudspeaker according to claim 15, wherein the first member and the second member are made of aluminum.

19. The loudspeaker according to claim 15, wherein a shielding member is positioned between the first driver and the second driver.

* * * * *